United States Patent [19]

Banyai et al.

[11] Patent Number: 4,863,512

[45] Date of Patent: Sep. 5, 1989

[54] BINDER FOR METAL-CONTAINING ORES

[75] Inventors: Bruce E. Banyai; Denis E. LaSota; Dennis L. Strunk, all of New Castle County, Del.

[73] Assignee: Aqualon Company, Wilmington, Del.

[21] Appl. No.: 67,753

[22] Filed: Jun. 29, 1987

[51] Int. Cl.[4] ..... C22B 1/16

[52] U.S. Cl. ..... 75/5; 106/194

[58] Field of Search ..... 106/194; 75/0.5 R, 3, 75/5, 4

[56] References Cited

U.S. PATENT DOCUMENTS

| | | | |
|---|---|---|---|
| 3,376,145 | 4/1968 | Wallace | 106/194 |
| 3,893,847 | 7/1975 | Derrick | 75/3 |
| 4,288,245 | 9/1981 | Roorda et al. | 75/0.5 |
| 4,597,797 | 7/1986 | Roorda et al. | 106/194 |
| 4,614,539 | 5/1985 | Rosen et al. | 75/3 |

FOREIGN PATENT DOCUMENTS

| | | |
|---|---|---|
| 0026178 | 3/1971 | Australia . |
| 46544/85 | 8/1985 | Australia . |
| 0203854 | 3/1986 | European Pat. Off. . |
| 0203855 | 3/1986 | European Pat. Off. . |
| 2102124 | 7/1973 | France . |
| 63-185323 | 7/1988 | Japan . |
| 1198128 | 1/1984 | U.S.S.R. . |

OTHER PUBLICATIONS

Chemical Abstracts, vol. 108, 1988, p. 257, #135852y, 12/15/87.

Chemical Abstracts, vol. 97, 1982, p. 253, #76314d, 12/82.

Chemical Abstracts, vol. 74, 1971, p. 114, #143877e, 12/70.

Bulletin No. 1—FMC Food Phosphates—Chemistry, Nomenclature, and General Functions, (pp. 1-12), 12/1986.

FMC—Food Grade Phosphates and Phosphoric Acid, (pp. 1-91), 12/86.

"Organic Binders for Iron Ore Pelletization", Kater and Steeghs.

"Substitutes for Western Bentonite in Magnetic Taconite Pellets", Society of Mining Engineers of AIME Prepublication Number 76-B-11 12/1976), Clum, Heins and Tiemann.

"Role of Detergent Builders in Fabric Washing Formulations", 55 J. Am. Oil CHemists' Soc. 49, (Jan. 1978), M. W. Hollingsworth.

"Surfactants and Detergent Raw Materials", Chemical Economics Handbook—SRI Int'l., (Aug. 1981).

*Primary Examiner*—S. Kastler

*Attorney, Agent, or Firm*—Mark D. Kuller

[57] ABSTRACT

A binder useful for agglomerating a concentrated ore material in the presence of water comprising an alkali metal salt of carboxymethyl cellulose and sodium tripolyphosphate, a process for agglomerating the concentrated ore material using this binder, and the agglomerated product of this process, are disclosed.

6 Claims, No Drawings

BINDER FOR METAL-CONTAINING ORES

This invention is directed to a novel binder for agglomerating concentrated ore, a novel process for agglomerating concentrated ore using this binder, and the agglomerated product of this process. More specifically, this invention is directed to a binder useful for agglomerating or pelletizing particles of a concentrated ore, in particular, iron-containing ore, containing an alkali metal salt of carboxymethyl cellulose and sodium tripolyphosphate, the process of agglomerating or pelletizing the concentrated ore and the resulting agglomerated particles or pellets.

Raw or pig iron, used for making steel, is generally prepared by sintering a composition consisting of concentrated iron ore, consisting of iron oxide and residual silica (e.g., quartz), flux (e.g., limestone or dolomite), and coke. The flux is added to purge impurities, i.e., neutralize the silica. Slag, which results from this neutralization process, separates from the molten iron in the blast furnace. There is presently a desire to increase the efficiency of blast furnaces by reducing the volume of slag. Correspondingly, it is desired to reduce the cost of steel by reducing the amount of flux necessary for producing pig iron, i.e., by reducing the amount of silica entering the blast furnace.

The concentrated iron ore used in steel making is obtained from mined ores comprised of host rock, i.e., rock comprised of silica and iron oxide. In order to reduce shipping and handling costs iron oxide is normally separated from the host rock at or near the mine by, for example, magnetic and/or froth flotation processes. Many ores, in particular the taconite ore found in North America, require ultra fine grinding prior to carrying out such separation processes. Due to this grinding the resulting concentrated ore is a fine powder which cannot be easily handled, shipped, or charged to a blast furnace. Therefore, the concentrated ore is agglomerated into porous particles or pellets generally having an average diameter of approximately ⅜ inch by rotating the concentrated ore powder in a drum or disc with a binder and water to form balls, followed by firing the balls at about 2400° F. in an indurating furnace. The resulting particles or pellets are hard and are easily handled, shipped, and charged to a blast furnace.

Until recently, bentonite clay was the binder of choice for agglomerating concentrated ore particles as it provides moisture and growth control, and balls prepared with bentonite have very good wet and dry strength. One problem with bentonite is that it contains a large amount of silica. In the blast furnace, this silica must be neutralized by adding additional amounts of flux over that required to neutralize the host rock. Accordingly, there has been a desire to replace bentonite with a product that has all the attributes of bentonite, but does not contribute silica to the pellet. The so-called "organic based binders", such as the alkali metal salts of carboxymethyl cellulose, have been considered as replacements for bentonite as they do not contain silica and, therefore, do not require use of additional flux and create additional slag. Instead, they burn off during sintering.

In the blast furnace, reducing gases, such as carbon monoxide, reduce iron oxide to the metallic state. The rate of reduction is directly proportional to the ratio of surface area/mass of the concentrated ore-containing pellets. The pore volume and, thus, the surface/mass ratio of pellets produced using organic binders is larger than that of pellets produced using bentonite. Moreover, during sintering, bentonite fuses to a glass-like ceramic material which seals pores. In contrast, the pore volume of pellets produced using organic binders increases as the organic binder burns off. Due to the larger surface area of the pellets produced using organic binders their reduction is much more efficient than is that of pellets prepared with bentonite.

Although the alkali metal salts of carboxymethylcellulose are effective binders, they do not impart adequate dry strength at economical use levels. Roorda, in U.S. Patent Nos. 4,288,245 and 4,597,797, discloses that the performance of alkali metal salts of carboxymethyl cellulose can be improved by inclusion of one or more salts derived from an alkali metal and a weak acid having a pK value higher than 3 and a molecular weight lower than 500, in amount of at least 2%, calculated on the weight of the carboxymethyl cellulose. Exemplary are salts of acetic acid, benzoic acid, lactic acid, propionic acid, tartaric acid, succinic acid, citric acid, nitrous acid, boric acid and carbonic acid, such as sodium carbonate and sodium citrate. One such binder is marketed under the name Peridur ® and is believed to contain the sodium salt of carboxymethyl cellulose, sodium carbonate, and side-products from the formation of the carboxymethyl cellulose salts including sodium chloride and sodium glycolate.

Applicant has studied binder compositions containing alkali metal salts of carboxymethyl cellulose and discovered that the performance of such salts is greatly enhanced by the inclusion of sodium tripolyphosphate. Accordingly, this invention is a binder composition, useful for agglomerating a metal-containing ore material in the presence of water, comprising about 10% to about 90% of an alkali metal salt of carboxymethyl cellulose and about 5% to about 90% of sodium tripolyphosphate, both by total dry weight of the binder composition. In another aspect, the invention is directed to a process for agglomerating a concentrated ore material, which process comprises (a) preparing a mixture comprising a binding amount of an alkali metal salt of carboxymethyl cellulose, sodium tripolyphosphate, water and concentrated ore, (b) agglomerating the mixture into wet balls, and (c) drying the wet balls and heating the resultant dry balls at a temperature of at least about 2200° F.; and the agglomerated product of this process.

Any substantially water-soluble alkali metal salt of carboxymethyl cellulose may be used in this invention. Preferred is the sodium salt. Alkali metal salts of carboxymethyl cellulose, more particularly sodium carboxymethyl cellulose, are generally prepared from alkali cellulose and the respective alkali metal salt of monochloroacetic acid. Cellulose which is used in the manufacture of carboxymethyl cellulose is generally derived from wood pulp or cotton linters, but may be derived from other sources such as sugar beet pulp, bagasse, rice hulls, bran, microbially-derived cellulose, and waste cellulose (e.g., shredded paper). The sodium carboxymethyl cellulose used in this invention generally has a degree of substitution (the average number of carboxymethyl ether groups per repeating anhydroglucose chain unit of the cellulose molecule) of from about 0.4 to about 1.5, more preferably about 0.6 to about 0.9, and most preferably about 0.7. Generally the average degree of polymerization of the cellulose furnish is from about 300 to about 4000. Polymers having a degree of polymerization on the higher end of the range are preferred. However, best results are obtained with sodium carboxymethyl cellulose having a Brookfield viscosity in a 1% aqueous solution of less than about 4,000 cps at 20 rpm.

Sodium tripolyphosphate is a powder or granular salt having the formula $Na_5P_3O_{10}$ prepared by evaporating a saturated orthophosphate solution and calcining at 500° C. It is commercially available from FMC Corporation of Philadelphia, Pennsylvania under its generic name. Commercially available products generally contain minor amounts of impurities, e.g., disodium pyrophosphate and tetrasodium pyrophosphate. Other phosphate salts, such as monosodium phosphate (sodium phosphate mono basic), disodium phosphate (sodium phosphate di basic), sodium tripolyphosphate, tetrapotassium pyrophosphate, tetrasodium pyrophosphate, and sodium metaphosphate ($(NaPO_3)_n$ wherein n is 2 or more (sodium metaphosphate wherein a is 6, 13 and 21 are commercially available from FMC Corporation)), have similar properties to sodium tripolyphosphate.

The amounts of alkali metal salt of carboxymethyl cellulose and sodium tripolyphosphate to be used in the binder composition of this invention are dependent on the specific agglomeration method used, the nature of the concentrated ore to be agglomerated and the desired properties of the agglomerates to be prepared. A person of ordinary skill in the art can readily determine the specific amounts that will be most suitable for individual circumstances. Pelletization is generally carried out using carboxymethyl cellulose in an amount of about 10% to about 90%, more preferably about 30% to about 70%, and sodium tripolyphosphate in amount of about 5% to about 90%, more preferably about 30% to about 70%, both by total dry weight of the binder composition.

The binder composition may also contain other substances, for instance, those that are formed as by-products in the preparation of the alkali metal salt of carboxymethyl cellulose, such as sodium chloride and sodium glycolate, as well as other polysaccharides or synthetic water-soluble polymers and other "inorganic salts" (for want of a better term sodium carbonate, sodium citrate, and the like are referred to as "inorganic salts" herein). Exemplary polysaccharides include, e.g., hydroxyethyl cellulose, hydroxypropyl cellulose, hydrophobically modified hydroxyethyl cellulose, methyl cellulose, hydroxypropyl methyl cellulose, guar, hydroxypropyl guar and sugar beet pulp, etc. Exemplary synthetic water-soluble polymers include polyacrylamide, polyvinyl alcohol, styrene/maleic anhydride copolymers, and polyacrylate, etc. Exemplary inorganic salts include, e.g, the salts described by Roorda in U.S. Patent Nos. 4,288,245 and 4,597,797, such as sodium carbonate, sodium citrate, etc., and the aforementioned phosphates.

Any known method for forming dry pellets or particles can be used to prepare the agglomerates of this invention. For instance, the concentrated ore may be agglomerated into particles or pellets by rotating the concentrated ore powder in a drum or disc with a binder and water, followed by drying and firing. Pellets can also be formed by briquetting, nodulizing, or spray drying.

Addition of the binder composition constituents may be carried out in a manner commonly applied in the art. For instance, the binder constituents may be mixed as solid matter with the concentrated ore or while dissolved in water. Further, they may be simultaneously, successively or alternatively added to the concentrated ore before or during the pelletizing treatment. In a preferred method the binder composition is added to a moist concentrated ore resulting from the aforementioned separation process, which has all but about 10 wt. % of the water removed by, e.g., rotating disc filter, at a sufficient point upstream from the agglomerating drum or disc so that the binder components and concentrated ore are well mixed and adequately hydrated prior to being formed into balls.

The ratios of alkali metal salt of carboxymethyl cellulose, sodium tripolyphosphate and water to concentrated ore used in the process of this invention are dependent on the specific agglomeration method used, the nature of the ore material to be agglomerated and the desired properties of the agglomerates to be prepared. A person of ordinary skill in the art can readily determine the specific amounts that will be most suitable for individual circumstances. Pelletization is generally carried out using the binder composition in an amount of from about 0.0044% to about 0.44%, preferably from about 0.022% to about 0.22%, of the binder composition and about 2% to about 20%, preferably about 5% to about 15%, water, both by weight of the total dry mixture. In addition, clays such as bentonite clay may be used in pelletization. The total amount of these clays will depend on the user's objectives, but will generally be less than 0.22%, based on the weight of the total dry mixture.

Small amounts of flux, e.g., limestone or dolomite, may also be added to enhance dry strength. The flux also helps to reduce the dust level in the indurating furnace when the balls are fired. Olivine, serpentine and similar minerals may be used to improve fired pellet properties.

Drying the wet balls and firing the resultant dry balls may be carried out as one continuous or two separate steps. The important factor is that the balls must be dry prior to firing as the balls will degrade or spall if fired without first drying them. Thus, in one embodiment of this invention, the wet balls are heated slowly to a temperature of at least about 2200° F., preferably to at least about 2400° F., and then fired at that temperature. In another embodiment, they are dried at low temperatures, preferably by heating, or, alternatively, under ambient conditions, and then fired at a temperature of at least about 2200° F., more preferably at about 2400° F. Firing is carried out for a sufficient period of time to bond the small particles into pellets, generally about 15 minutes to about 3 hours.

The process of this invention is generally employed with concentrated iron ore. This process is also suitable for non-ferrous concentrated ores such as ores of zinc, lead, tin, nickel and chromium and oxidic materials such as silicates and quartz, and sulphidic materials. As a practical matter, this invention is intended for use in binding the concentrated ores which result from separation of the host rock from the ore removed from the ground. However, it can also be used to bind natural ores.

The pellets resulting from this process are dry, hard agglomerates having sizes that are suitable for, e.g., shipping, handling, sintering, etc. Pellets generally have an average diameter of about ¼ to about ¾ inch, preferably about ⅜ inch. Pellet size is generally a function of the user and operator's preference, more than of binding ability of the compositions of this invention and virtually any size pellet desired by blast furnace operators and mine operators can be prepared.

This invention is illustrated in the following examples, wherein all parts, percentages, etc., are by weight unless otherwise indicated.

EXAMPLE

This example is directed to preparation and testing of wet and dry balls prepared using the binder of this invention.

The ore used was a magnetic taconite concentrate containing approximately 65 wt. % iron and approximately 4.6 wt. silica obtained from a U.S. operation. In a Hobart model N-50 oscillating mixer, 3240 g of the ore concentrate, having a moisture content of 7.4%, was mixed with additional water (distilled) to obtain the desired moisture level. The chosen quantity of dry binder blend was then sprinkled onto the surface of the moist concentrated ore and mixing was continued for 3 minutes. Next, the concentrate ore/binder mix was passed one time through a high speed shredder to make a uniform, clump free blend suitable for balling.

Balls were made in a 15 inch diameter (size 6.00–6) airplane tire, rotated at a rate of 65 revolutions per minute with the axis of rotation being horizontal, as follows:

1. Small amounts of concentrated ore were fed by hand int the rotating tire alternately with distilled water mist. As seed balls formed they were removed and hand screened to −4.75, +4 mm. A portion (800 g) of concentrate was set aside for seed preparation. This process was continued until at least 100 g of seed balls were generated.
2. Ninety-two (92) g of prepared seed balls were put in the rotating tire and moistened slightly with a fine mist spray of distilled water. Part of the remaining 2440 g of concentrate was added to the seeds as quickly as possible over a 1 minute period. The balls were removed and the newly formed seeds (−4.75 mm) were screened out and discarded.
3. The +4.75 mm balls were returned to the rotating tire and the remainder of the concentrate was added over a 1 1½ minute time period. The finished balls were then rolled for 5 seconds.
4. The wet balls were screened to determine size distribution. A −12.7, +11.2 mm cut was used to determine moisture content.

Two standard tests were used to measure performance, i.e., the drop test and the compressive strength test. The drop test and compressive strength test demonstrate the ability of wet and dry balls to withstand cracking under normal handling conditions. Balls must have sufficient prefired strength so that they do not crack during handling or transfer in the pellet plant, but must not be so plastic that they deform and impair bed permeability in the indurating furnace.

The drop test was carried out by dropping the wet balls repeatedly from a height of 18 inches onto a smooth steel plate. The number of drops required to crack a ball was recorded and the average value for 10 balls reported.

Compressive strength was measured by applying pressure to both wet and dry pellets until the pellets crumbled. The apparatus consisted of a Chatillon Model No. LTCM-3 spring testing device (manufactured by John Chatillon Company, New York, N.Y.) with appropriate range dial push-pull gauge (5 lb. capacity for wet, 25 lb. for dry). Dried balls were obtained by placing green balls in a 105° C. oven for 18 hours. Average wet ball moisture was determined by comparing the weight of balls before and after drying. Compressive strength results presented are also the average of 10 balls tested.

The formulations used and results obtained are shown in the following Table.

TABLE 1

| | Polysaccharide(s)[1] (%) | D.P.[2] | D.S.[3] | STPP[4] (%) | Drop Number | Wet Compr. Strength (lbs.) | Dry Compr. Strength (lbs.) | Ball Moisture (%) |
|---|---|---|---|---|---|---|---|---|
| 1 | 0.033 NaCMC[5] | 3200 | 0.7 | 0.033 | 4.1 | 1.7 | 10.5 | 8.0 |
| 2 | 0.033 NaCMC | 3200 | 0.7 | 0.033 | 11.2 | 2.9 | 13.3 | 8.9 |
| 3 | 0.033 NaCMC | 3200 | 0.7 | 0.033 | 14.9 | 3.2 | 13.8 | 9.8 |
| 4 | 0.033 NaCMC | 400 | 0.7 | 0.033 | 6.0 | 3.1 | 10.8 | 9.3 |
| 5 | 0.033 NaCMC | 1100 | 0.7 | 0.033 | 9.1 | 3.3 | 14.4 | 9.2 |
| 6 | 0.033 NaCMC | 3200 | 0.7 | 0.033 | 15.8 | 3.3 | 15.9 | 9.5 |
| 7 | 0.064 NaCMC | 3200 | 0.7 | 0.003 | 13.8 | 2.9 | 11.2 | 9.2 |
| 8 | 0.030 NaCMC | 3200 | 0.7 | 0.037 | 16.3 | 3.2 | 14.0 | 9.2 |
| 9 | 0.010 NaCMC | 3200 | 0.7 | 0.057 | 5.6 | 2.8 | 11.7 | 9.2 |
| 10 | 0.011 NaCMC | 3200 | 0.7 | 0.011 | 3.1 | 2.3 | 3.2 | 8.8 |
| 11 | 0.033 NaCMC | 3200 | 0.7 | 0.033 | 11.2 | 3.1 | 10.2 | 9.0 |
| 12 | 0.067 NaCMC | 3200 | 0.7 | 0.067 | 17.3 | 3.4 | 17.3 | 9.8 |
| 13 | 0.022 NaCMC | 3200 | 0.7 | 0.022 | 10.1 | 3.1 | 10.6 | 9.5 |
| | 0.022 SBP[6] | — | — | | | | | |

[1]Percentage is based on the total weight of the dry composition, including concentrated ore.
[2]Degree of polymerization of the polysaccharides.
[3]Carboxymethyl degree of substitution.
[4]Sodium tripolyphosphate. Percentage is based on the total weight of the dry composition, including concentrated ore.
[5]Sodium carboxymethyl cellulose.
[6]Cellulose derivative produced from sugar beet pulp sold by Petroleum Fluids Incorporated, Houston, Texas, under the name HP-007 having an apparent viscosity at 7 lbs./barrel in a 4% CaCl solution of 18.5 cps.

Generally mine operators require that green balls be able to withstand at least 6 drops. Similarly, dry compressive strength of 10 or more pounds is desired. In practice, however, it has been difficult to attain dry strengths of greater than 5 lbs. with non-bentonite binders at economically acceptable use levels.

Samples 1–3 demonstrate that the invention is effective over the range of ball moisture levels normally encountered at taconite production facilities. As can be seen, wet ball physical properties are improved by increasing moisture content. Also, dry ball strengths in excess of 10 lbs. are attained. These values are unusually high compared to other commercially available organic binders.

Samples 4–6 show that sodium carboxymethyl cellulose having a wide range of molecular weight has utility in this invention. Generally, higher molecular weight sodium carboxymethyl cellulose impacts greater impact resistance to the wet ball formed. This effect is significantly less noticeable in the dry strength data where the sodium tripolyphosphate shows a considerable leveling effect.

Samples 7–9 show that the ratio of sodium carboxymethyl cellulose to sodium tripolyphosphate can be varied widely for effective use as a taconite binder. In addition, the results indicate that sodium tripolyphosphate itself does not give adequate drop number to be considered an effective binder. The best overall performance occurred when the sodium carboxymethyl cellulose and sodium tripolyphosphate were present in nearly equal quantities.

Samples 10–12 illustrate the most effective, practical dosage range over which the 1/1 sodium carboxymethyl cellulose/sodium tripolyphosphate binder can be used. Effective dosage will, in practice, be determined by the moisture level present in the concentrate In this case, a total dosage of 0.066% worked well at a ball moisture level of about 9% (Sample 11). Higher total dosage levels can be readily used. However, the water level ii the system will have to be increased (as was the case in sample 12) to compensate for the polymer's tendency to bind free water to itself too tenaciously and reduce wet strength of the agglomerate.

Sample 13 shows that other polymers can be used as effective partial replacements for the carboxymethyl cellulose of the invention.

While this invention has been described with respect to specific embodiments, it should be understood that these embodiments are not intended to be limiting and that many variations and modifications are possible without departing from the scope of this invention.

We claim:

1. A binder composition useful for agglomerating a concentrated ore in the presence of water comprising about 10% to about 90% of an alkali metal salt of carboxymethyl cellulose and about 5% to about 90% sodium tripolyphosphate by total dry weight of the binder composition.

2. The binder composition claimed in claim 1 wherein the carboxymethyl cellulose is contained in amount of about 30% to about 70% and the sodium tripolyphosphate is contained in amount of about 30% to about 70%, by weight of the total composition.

3. The binder composition claimed in claim 1 wherein the alkali metal salt of carboxymethyl cellulose is a sodium salt having a degree of substitution of about 0.4 to about 1.5.

4. The binder composition claimed in claim 2 wherein the alkali metal salt of carboxymethyl cellulose is a sodium salt having a degree of substitution of about 0.6 to about 0.9.

5. The binder composition claimed in claim 2 wherein the alkali metal salt of carboxymethyl cellulose is a sodium salt having a degree of substitution of about 0.7.

6. The binder composition claimed in claim 4 wherein the alkali metal salt of carboxymethyl cellulose is formed from a cellulose furnish having an average degree of polymerization of 300 to 4000.

* * * * *

UNITED STATES PATENT AND TRADEMARK OFFICE

CERTIFICATE OF CORRECTION

PATENT NO. : 4,863,512
DATED : September 5, 1989
INVENTOR(S) : BANYAI, LaSOTA & STRUNK It is certified that error appears in the above-identified patent and that said Letters Patent is hereby corrected as shown below:

Column 5, line 28

" int" should read -- into --

Column 7, line 4

" impacts" should read -- imparts --

Column 7, line 27

" ii " should read -- in --

Signed and Sealed this

Fifth Day of February, 1991

*Attest:*

*Attesting Officer*

HARRY F. MANBECK, JR.

*Commissioner of Patents and Trademarks*